United States Patent [19]

Breton et al.

[11] 4,353,238

[45] Oct. 12, 1982

[54] METHOD FOR MANUFACTURE OF SEAMLESS METAL TUBING BY CONTINUOUS ROLLING

[75] Inventors: Jean-Jacques Breton, Anzin; Philippe Malicet, Saint-Saulve, both of France

[73] Assignee: Vallourec, Societe Anonyme, Paris, France

[21] Appl. No.: 264,347

[22] Filed: May 18, 1981

[51] Int. Cl.[3] ..... B21B 17/10

[52] U.S. Cl. ..... 72/209

[58] Field of Search ..... 72/96, 97, 208, 209, 72/234, 235, 250, 370

[56] References Cited

U.S. PATENT DOCUMENTS 970,263 9/1910 Peters ..... 72/209

981,281 1/1911 Kalle ..... 72/209

3,857,267 12/1974 Lemaire et al. ..... 72/209

*Primary Examiner*—Ervin M. Combs

[57] ABSTRACT

A method for hot rolling of a tubular blank over a mandrel in a mill utilizing a plurality of roll stands. The blank and mandrel are inserted into the mill and moved through the mill in a fashion such that the mandrel is present and controlled at each roll stand at the time that the blank leading end reaches each roll stand. The blank enters the mill inlet stand at a speed, $V_e$, and the speed of the mandrel is controlled during all times that the blank is engaged at any roll stand. The control mechanisms achieve movement of the mandrel in the same direction as the blank and at a constant speed, $V_m$, with the ratio $V_m/V_e$ being maintained between about 0.75 and 1.3.

5 Claims, 3 Drawing Figures

SPACE
TIME
A
B
C
D
E
1
2
3
4
5
6
7
8
9
10
11
12
13
14
15
16
Vm
Ve
Vt
b
b'
c
c'
d
d'
e
ld

METHOD FOR MANUFACTURE OF SEAMLESS METAL TUBING BY CONTINUOUS ROLLING

BACKGROUND OF THE INVENTION

This invention relates to the manufacture of seamless metal tubing and concerns a new continuous hot rolling method and the apparatus for implementing such method.

The manufacture of seamless metal tubing by hot rolling in a continuous mill generally includes the following steps: hot piercing of a solid round billet of a given length having been previously heated to a given temperature, in order to get a tubular heavy-wall blank or shell having already undergone a first elongation, and then hot rolling the obtained shell in a continuous mill which delivers a tube of controlled diameter and wall thickness. Later on, the tube is generally subjected to a number of additional hot or cold operations performed in order to meet the required specifications.

Depending on the size of the incoming billet and the size of the tubes to be produced, an additional intermediate elongation operation can be performed between piercing and rolling, intending to condition the shell delivered by the piercing mill in order to obtain a new shell making it possible to use the continuous mill under good conditions.

Piercing is generally performed in a rotary type piercing mill. The principle of this mill is to push the solid round billet by transverse rolling which develops axial force to drive the billet over a piercing plug which is axially held in position by the piercing bar over which the shell leaving the mill moves.

Rolling is performed in a continuous mill composed of a number of successive roll stands aligned in roll pass centerline, the planes of symmetry perpendicular to the roll axes of alternate stands being disposed at 90°.

The number of roll stands used in a mill is variable. It depends on the elongation ratio to be achieved during the rolling. For an elongation of 4.5 to 1 generally 8 stands are employed, the elongation being the ratio of the length of the rolled tube to the length of the incoming tubular shell.

Each stand is equipped with two driven rolls having grooves of symmetrical profile with a more or less pronounced side relief so as to permit metal flow and deformation to take place under good conditions.

Several techniques or methods are available for continuous rolling of seamless tubing in this type of mill: rolling over a full-floating mandrel and rolling over a retained mandrel.

These methods implement a mandrel over which the tubular shell is being rolled as it passes through the successive stands, the main difference lying in the way the mandrel is moved during the rolling operation.

In the method of the full-floating mandrel, the tubular shell with its long mandrel inside is inserted into the inlet roll stand of the mill and the mandrel takes an average speed which is the resultant of the speeds of the tube being rolled at every roll stand.

The rolled tube partially covering the mandrel is collected at the exit of the mill and mandrel stripping is then performed.

Thus, in this method, the mandrel is not connected to any mechanical or other speed control device during the rolling operation.

The limits and draw-backs of this process are well known. There can be mentioned: limitation of the length of the rolled tube unsteady working conditions as the product enters and leaves the mill and, thus, tube size variations for the corresponding cross section, relatively long mandrel length, and mandrel stripping difficulties leading to rejections due to stripping incidents mainly for thin-wall tubing.

In the method of the retained mandrel, the pierced shell with its long mandrel inside is inserted into the inlet roll stand of the mill, but then the mandrel is retained and moved during rolling over a distance corresponding to twice the roll stand center distance which is generally considered at the last stands of the mill. In this method the mandrel is thus connected to a mechanical or other speed control device which holds the mandrel and forces it to move at a speed less than its natural speed rate.

Thus, one always manages to have the tube rolled over the mandrel as the tube and the mandrel proceed through the mill, but as the mandrel only moves over a short distance, it is moved at a very slow speed that is to say at a speed rate considerably less than the linear shell entry speed into the mill and generally much less than 50% of that speed.

This results in severe rolling conditions, and special provisions must be made when manufacturing and using the mandrel in this method.

This basic difficulty resulting from the difference of the speeds of the mandrel and the shell during the rolling is well-known and has given rise to many publications dealing with the design of the mandrels, their lubrication, their internal cooling, and their surface conditioning.

Among these documents, there can be quoted the French Pat. Nos. 1 224 862 and 1 458 826, the U.S. Pat. No. 3,394,568, and the article of M. Dvorak et al. in BTF-Gennaio-Febbraio 1980, pages 4 and 5.

In the retained mandrel method, the mandrel is much shorter than the one of the first mentioned "full-floating" method. The rolled tube leaves the mill at its exit end, and the mandrel is generally retracted backwards after use.

In spite of the advantages as compared to the full-floating mandrel method, the retained mandrel method, however, also has its limitations and draw-backs. The high relative shell/mandrel speed during the rolling operation results in heating and rapid wear of the mandrel and entails very high operating costs because of the mandrels which burden the process as a whole.

Such a method is described in the French Pat. No. 1 322 304.

In another method which is described in the U.S. Pat. No. 3,857,267 attempts were made to eliminate the draw-backs inherent in the full-floating and the retained mandrel processes by imposing to the mandrel a constant speed all through the rolling operation, this speed being calculated so that the available length is always at least equal to the length strictly required for the considered rolling operation, thus the mandrel can be released through the mill at the end of the rolling operation. This results in an increase in productivity as compared to the retained mandrel process in which the mandrel is retracted backwards after use.

In the method implementing a mandrel moving at controlled speed, various operation conditions can be used for the actual rolling operation.

More particularly it has been proposed to move the mandrel at speeds being variable according to the position of the tubular shell under rolling in order to ensure a product quality as uniform as possible and to solve the above mentioned problems.

In spite of all the precautions that can be taken for operating the retained mandrel process or its alternates, the question of the life of the mandrels in service remains an important problem.

OBJECT OF THE INVENTION

An object of the present invention is to bring about a significant improvement in the rolling method with controlled mandrel speed by defining the specific operation conditions of this method.

Another object of the present invention is the provision of a continuous rolling method ensuring a good life of the mandrels in service.

Another object of the present invention is the provision of a continuous rolling apparatus which permits the obtaining of tubes of high dimensional quality at a lower investment cost.

DESCRIPTION OF THE PREFERRED EMBODIMENT

Figure 1:
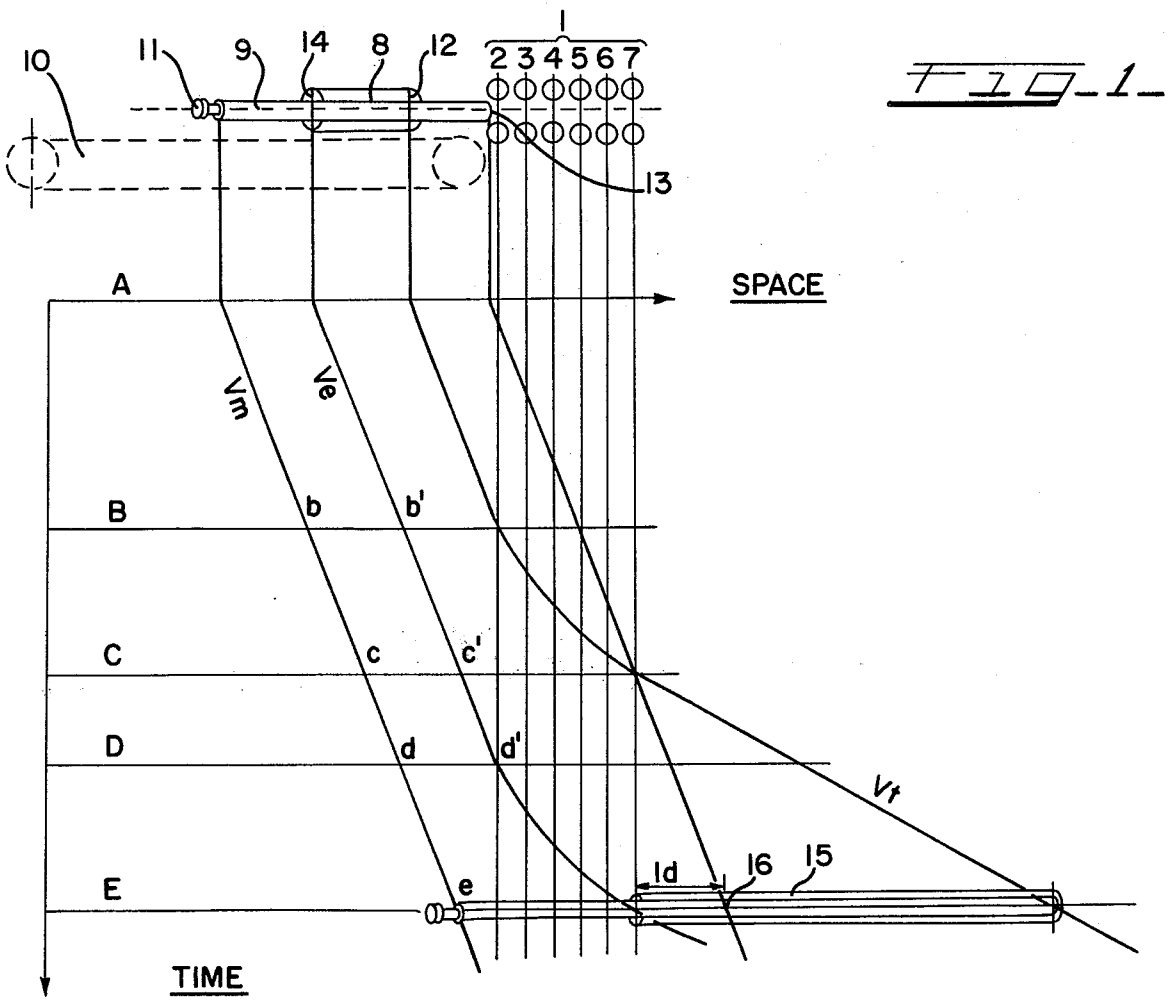
FIG. 1 shows the relative motion of the mandrel and the shell as a function of time according to the method of the present invention.

In order to achieve the above objects, the rolling method of the invention consists in rolling a tubular shell over an inside mandrel the length of which is greater than the length of the incoming shell and/or greater than the length of the mill between the first and the last stands, the mill embodying a plurality of successive driven stands equipped with grooved roll pairs providing the successive passes of decreasing section, the alternate roll stands being disposed at 90° to each other.

The shell together with its inside mandrel is positioned in front of the entry of the inlet stand of the mill. The shell and mandrel are then inserted into the mill in such a way that at the time that the shell enters the first roll stand, the mandrel forward end be inside the mill without protruding beyond the outlet stand. The mandrel is moved axially in the same direction as the shell at a constant speed rate so that the mandrel will at least reach each roll stand, including the outlet stand, at the time that the tube forward end reaches the corresponding stand. The linear axial forward speed of the mandrel with respect to the mill ranges approximately between 0.75 and 1.30 times the linear entry speed of the shell to be rolled into the inlet stand under steady operating conditions.

If Vm is the axial linear mandrel feed speed with respect to the mill and Ve the linear speed of the shell entering the mill, the process is characterized by a ratio Vm/Ve between 0.75 and 1.30.

A preferred embodiment of the present invention is to use a mandrel of such a length and positioned in such a way that at the time that the shell together with its mandrel enters the roll pass of the inlet mill stand a mandrel portion does not extend over more than three quarters of the length of the mill that is to say of the distance between the centers of the rolls of the first and the last stands, estimation starting from the inlet stand.

Thus, in spite of the above defined mandrel speed range, the portion of the rolled tube covering the mandrel when rolling is completed is short, and mandrel stripping which can be performed by any adequate means is much easier than in case of a full-floating mandrel.

Thus, in this method, combining the mandrel speed and initial mandrel positioning features, the tubular shell initially disposed onto its mandrel can be rolled under particularly favourable conditions while using a rather short mandrel as compared to the conditions in the full-floating method, which combined with the result described in the preceeding paragrah enables easy rolling of long and thin-walled tubes which are again longer than in the method of the full-floating mandrel.

Final mandrel stripping can be carried out by any known method. As a non-limitative example there can be quoted mandrel stripping in pass centerline immediately at the exit end of the mill by extraction stands provided for this purpose, the mandrel being secured at the rear end during the stripping operation and then either released so as to advance forward through the mill or retracted backward.

In another example, the mandrel can be released as soon as the tube clears the last roll stand of the mill; in such a case the tube carries the mandrel along with it through the mill, and stripping is performed in a separate facility whereupon the mandrel is recirculated.

In any case, the mandrel is recirculated after every rolling cycle simply after cooling and lubrication.

Thus, the process is featured by a set of several mandrels of the same diameter used for every range of close wall thicknesses of the rolled tubes.

The mandrel costs represent a large percentage of the tooling expenses of the method. These costs depend upon the length and the life of the mandrels.

Thus, this process defines perfectly steady rolling conditions from the time the forward end of the shell enters the inlet stand of the mill till the time that the outlet stand is cleared by the rearward end of the rolled tube.

However, in order to obtain a tube of good quality, as well from the geometrical as the dimensional point of view, it is not sufficient that the speed and the initial positioning parameters of mandrel and shell be steady and reproducible. It is additionally required that the evolution of the surface of the mandrel supporting the tube being rolled in each stand be such as not to endanger the steadiness of the general rolling conditions by creating a considerable dispersion between the conditions at the beginning and the end of the rolling operation of successive cycles.

This steadiness can only be obtained if the evolution conditions of the lubrication of the mandrel surface during rolling are mastered.

It is known that the steadiness of the rolling conditions is the better the more the rolling conditions, as regards the mandrel speed, of the full-floating mandrel method are approached, that is to say the more often the used portion of the mandrel surface is renewed during the rolling operation.

However, in order to limit the mandrel length, it is desirable to work at a speed as slow as compatible with a good rolling quality, especially for thin-walled tubes.

In fact, the total mandrel length is governed by three considerations: the length covered by the tube as rolling is completed and which is the length to be stripped, the length of the mill between the inlet and the outlet roll stands, and the length required by the retaining mechanism on the inlet side.

In this method, the mandrel length to be stripped is close to the product of the incoming shell length multiplied by the ratio Vm/Ve.

By way of experiment it has been noted that in case of slow rolling speeds, measured by small or very small values for the ratio Vm/Ve, the rolling conditions, become unsteady and/or the mandrel surface very rapidly deteriorated, thus requiring specific and particular operation precautions.

It has been established, nothing leading previously to this idea, that these detrimental phenomena are not progressive and that in industrial operation it is only necessary to reach a Vm/Ve ratio of at least approximately 0.75 so that a uniform lubricant film remains on the surface of the mandrel during and after the rolling operation, which is not the case for lower Vm/Ve values. This result is achieved whatever the method used for applying the lubricant.

Moreover, when the value of the ratio Vm/Ve is inferior to 0.75, one systematically observes rapid generation of skin cracks in the surface of the mandrel leading to the thought that this surface has undergone surface hardening.

It has further experimentally been noted that the separating forces in the first mill stands, where the loads are the heaviest (these forces being defined as those spreading the rolls apart), are reduced by 20% as compared to the full-floating mandrel method, if the mandrel speed rate is less than the speed of the tube being rolled in the considered roll stand.

Consequently, the thermal effects resulting mainly from the frictional work are considerably reduced, and the experience has shown that the max. mandrel speed has only to be limited to 1.3 times the shell entry speed into the first roll stand (or inlet stand) so as to meet the industrial rolling conditions nearly to the optimum.

A particularly advantageous alternate of the process according to the present invention is to use as the rolling mandrel the piercing bar supporting the piercing plug over which the shell has been fed during piercing or elongation performed immediately before the rolling operation.

This combination is particularly interesting because the results obtained with the mandrel speed choice as per the invention are even improved because of the reduced clearance between mandrel and shell which this alternate uniquely achieves. This permits working with die grooves which are more closed, more enveloping, thus further reducing the specific pressures on the mandrel.

The seams resulting from rolling are also smaller in size, thus, deformation and metal distribution from one stand to the next one are facilitated. It is possible to perform a considerable metal deformation in the first mill stands.

The rolling operation is carried out under the already described conditions. In such a case, the mandrels are of course recirculated between the exit of the mandrel mill and the exit of the piercer-elongator. The mandrel bar is lubricated before being used at the exit of the piercer-elongator.

This alternate of embodiment of the invention makes it possible to combine with the already quoted advantages those provided by the use of the same bar as piercing-elongating bar and rolling mandrel.

Thus, it is possible to build a mill which, for a given total rate of deformation or for making a given tube from a given shell, needs fewer roll stands than any mill working according to the earlier methods of the art.

Moreover, as the mandrel is used as piercer-elongator bar, guiding during the piercing operation is performed under better conditions and the shell to be rolled has a better geometrical uniformity. The finished tubes having been rolled in more enveloping grooves have an excellent concentricity for a hot rolled product.

The experience shows that the quality of the lubrication is not adversely affected by the use of the mandrel as piercing bar and that the choice of the mandrel speeds is not changed thereby.

Two other factors contribute to improve the rolling conditions:

- oxidation of the internal skin of the shell during piercing—mandrel insertion is reduced by the lubricant and because the air is not renewed
- the temperature of the shell to be rolled is higher because the time elapsed between piercing and rolling of a given shell is shorter.

All these conditions make the process of the present invention a superior method for the manufacture of high quality hot rolled tubes under enconomical conditions.

Another object of the present invention is an apparatus for the implementation of the method.

The apparatus comprises a continuous mill embodying successive stands disposed at 90° to each other, fitted with an inlet trough equipped with means for controlling the mandrel position prior to the rolling operation and the mandrel forward speed during rolling, an outlet trough, and means for collecting the mandrels after rolling so as to recirculate them after cooling and lubrication to the entry end of the mill for a new rolling cycle. The mill is provided with a mandrel speed control mechanism fit to impart to the mandrel a constant linear forward speed ranging between approximately 0.75 and 1.3 times the linear entry speed of the shell to be rolled into the mill inlet roll stand under steady operating conditions.

An alternate of the apparatus according to the method as per the present invention includes:

- a piercer or elongator roll stand
- a piercer or elongator plug supporting bar being successively used as piercing or elongation bar and rolling mandrel
- apparatus for transfer of the bar together with its shell from the exit of the piercing mill to the entry trough of the continuous mill
- a continuous mill embodying a number of successive roll stands disposed at 90° to each other, fitted with an inlet trough equipped with means for controlling the mandrel position prior to the rolling operation and the mandrel forward speed during the rolling operation, an outlet trough, means for collecting the mandrels after rolling so as to recirculate them after cooling and lubrication to the exit end of the piercer-elongator, such mill being equipped with a mandrel speed control mechanism fit to impart to the mandrel a constant linear forward speed ranging approximatly between 0.75 and 1.30 times the linear entry speed of the shell to be rolled into the mill inlet roll stand under steady operating conditions, wherein the roll grooves of the mill stands are more closed and nearer approach the circular section than in any mill operated by the previous method and wherein the number of roll stands required for a given elongation is at least one less than the number of roll stands in a mill operated by the former method.

Now, the present invention will be described by means of examples of execution.

On FIG. 1 which is a diagrammatic illustration of the rolling cycle according to the method of the invention, the time is represented along the axis perpendicular to the passline and the motions of the mandrel and blank along an axis parallel to the passline.

The mill 1 is shown by way of example as being made up of six roll stands 2, 3, 4, 5, 6, 7, the first or inlet stand being numbered 2 and the last or outlet stand 7.

To simplify the drawing, the roll stands are all shown in the same position, however, the stands are actually disposed at 90° to each other, the planes perpendicular to the axes of the rolls being generally at angles of 45° to the horizontal.

The shell 8 is shown at the entry end of the mill together with its mandrel 9. The mandrel speed and position control mechanism has the number 10 and the connection between this mechanism and the mandrel is made at the rearward end 11 of the mandrel, for instance by a disappearing fork which is not shown. At the time A (starting) the shell 8 together with its mandrel is simply deposited in the mill inlet trough, the mandrel being not yet engaged in the mill.

At the time B the forward end 12 of the shell 8 enters the inlet stand 2, the forward end of the mandrel 13 being then located between the 3rd and the 4th roll stand. The rolling operation starts.

Then and until the time E the mandrel is moved at constant speed. This speed Vm is illustrated by the slope or the straight line b c d e. The rearward end 14 of the shell advances at a constant speed Ve in order to have steady rolling conditions from the beginning. This speed Ve is represented by the slope of the straight line b′ c′ d′.

From B till C the mill is filled up by the shell.

At the time C, the mandrel forward end 13 and the shell leading end 12 simultaneously reach the outlet roll stand 7.

The rolled tube is discharged from time C. At the time D, the shell trailing end 14 passes the inlet roll stand and the mill starts to be cleared by the shell.

From time D till time E Vm is kept at the same value.

The finished tube 15 leaves the mill from time C to E at a constant speed Vt.

At the time E, the rolling operation is completed; then a portion ld of the mandrel is inside the trailing end of the rolled tube and the mandrel forward end 16 distinctly projects beyond the mill outlet roll stand.

In the present method the important feature is the value of the relative axial speed of the mandrel 9 with respect to the shell 8 as it enters the mill, in other words the ratio Vm to Ve. This ratio is chosen so that Vm/Ve be approximately comprised between 0.75 and 1.3. In the example represented on FIG. 1, these speeds, illustrated by the slopes of the straight lines b c d e and b′ c′ d′ are substantially equal, both lines being parallel.

Moreover, in order to benefit by the advantages of a short mandrel, The relative position of the forward end 13 of the mandrel with respect to the mill at the time that the shell enters the inlet roll stand shall be located at a distance less than three quarters of the length of the mill (distance between roll centers of stands 2 and 7) this distance being measured from the inlet roll stand.

In the example shown, at the time B, the mandrel fills approximately 50% of the length of the mill.

By way of example the method has been operated under the following conditions, using the alternate wherein piercing bar is used as a continuous rolling mandrel:

| | |
|---|---|
| shell length: | 6.8 m |
| shell size: | O.D. = 164.5 mm − wall thickness = 14.75 mm |
| finished tube length: | 30 m |
| finished tube size: | O.D. = 137 mm − wall thickness = 3.75 mm |
| mandrel length: | 16 m |
| Ve: | 1.40 m/s − Vt: 6 m/s |
| Vm: | 1.70 m/s |
| total number of roll stands: | 6, the last one only rounding up the tube and not reducing the wall thickness |
| total elongation: | 4.4 |
| ratio $\frac{Vm}{Ve}$ : | 1.21. |

The length of the mandrel is mainly determined by the length required by the roll stands, the mandrel length (ld) remaining inside the tube when the rolling operation is completed, and the space required by the mandrel motion control mechanism at the entry end of the mill.

The above defined rolling conditions resulted in an excellent life of the mandrels, which systematically only required a slight reconditioning after having rolled 4000 tubes per mandrel.

It is of course possible to fix the mandrel speed Vm not with respect to the shell entry speed into the first stand, but with respect to the speed of the first stand itself. This speed can for instace be calculated as the linear speed at half-depth of the roll groove.

The obtained ratio Vm to the linear speed of the roll stand is then less than the above mentioned rate.

Figure 2:
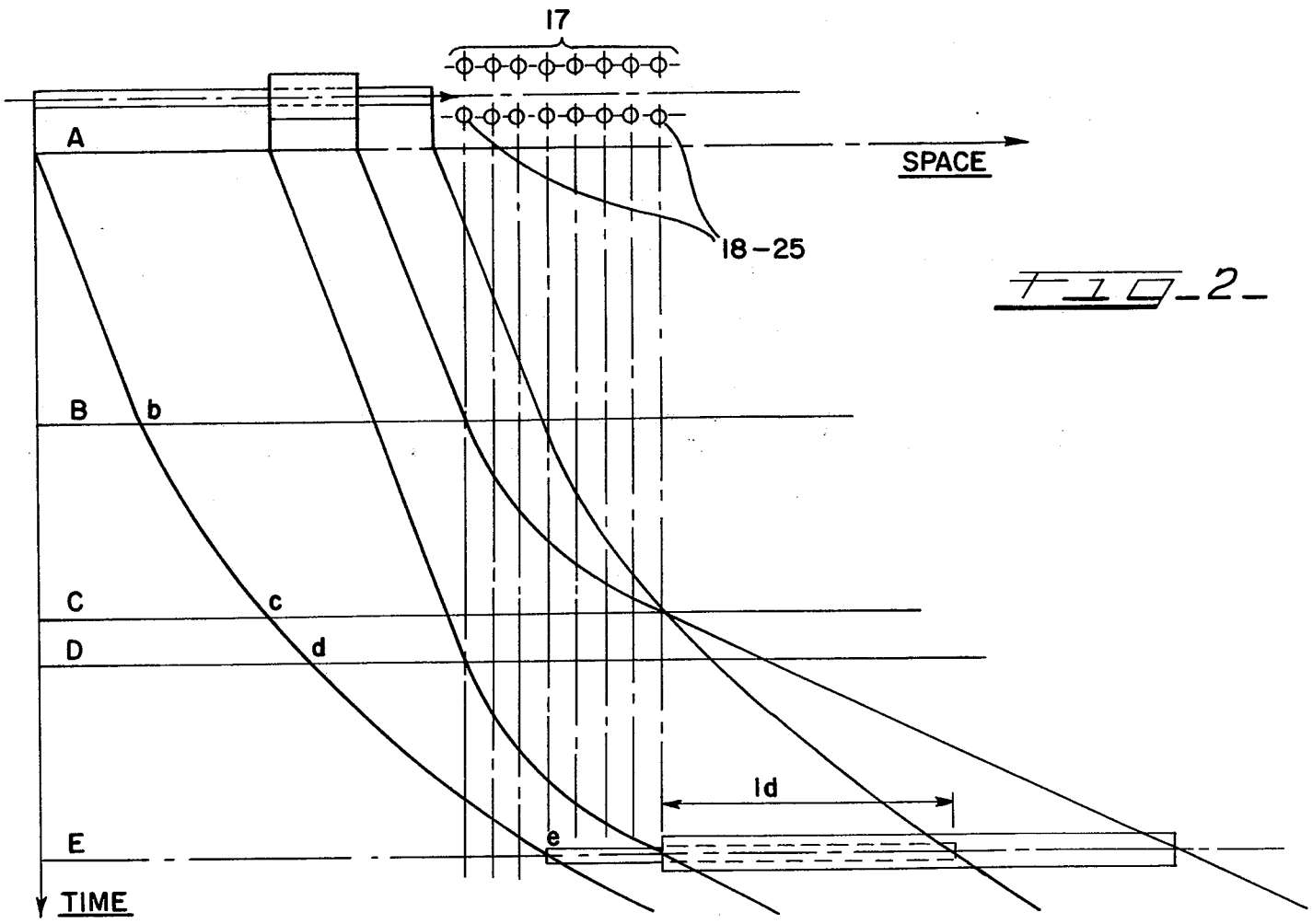
FIG. 2 shows the relative motion of the mandrel and the shell as a function of time according to the full-floating mandrel method; and, FIG. 3 shows the contour of a typical finishing roll groove of the mill of the invention as compared to the groove of a mill operated according to the prior art.

By way of comparison, FIG. 2 represents in a similar way as FIG. 1 a time-motion diagram of the full-floating mandrel process.

Here, there is no mandrel speed and positioning control mechanism and the continuous mill 17 is equipped with 8 roll stands.

As before, we have the time sequences A, B, C, D, E. In this figure, the mandrel speed illustated by the variable slope of the portions b-c, c-d, d-e is substantially variable. The mandrel is much longer than in FIG. 1, and the length ld is several times longer than the one in FIG. 1, thus entailing mandrel stripping difficulties.

According to the alternate of the invention, the mandrel 9 can be the piercer or elongator plug supporting bar of the forming operation immediately preceeding continuous rolling. In such a case, the clearance, between the mandrel 9 and the inside diameter of the shell 8 is reduced to a minimum. This clearance is of about 6 mm on the diameter for a shell I.D. of 135 mm and a shell length of 10 m.

The use of the piercing bar as rolling mandrel brings about a certain number of advantages among which can be quoted:

better guiding of the shell being pierced or elongated due to the reduced clearance between the piercing-elongating bar and the pierced or elongated shell, the piercing bar being adapted to each shell inside diameter to be rolled, piercing-elongation performed under good conditions as regards the plug, each plug being cooled and inspected along with the mandrel in the mandrel recirculation circuit prior to being used, less temperature loss between piercing-elongation and rolling, and, thus, better rolling conditions because there is only one transfer operation to be performed from the piercing-elongation line to the rolling line, little internal oxydation of the shell due to the pre-insertion of the mandrel and the provision of the lubricant.

Moreover, as the mandrel speed and the shell entry speed into the mill are closely related, shell insertion into the inlet stand of the mill entails no difficulties, no excessive impact and particularly does not require a pushing force exterior to the natural motion of the mandrel along with the shell.

Figure 3:
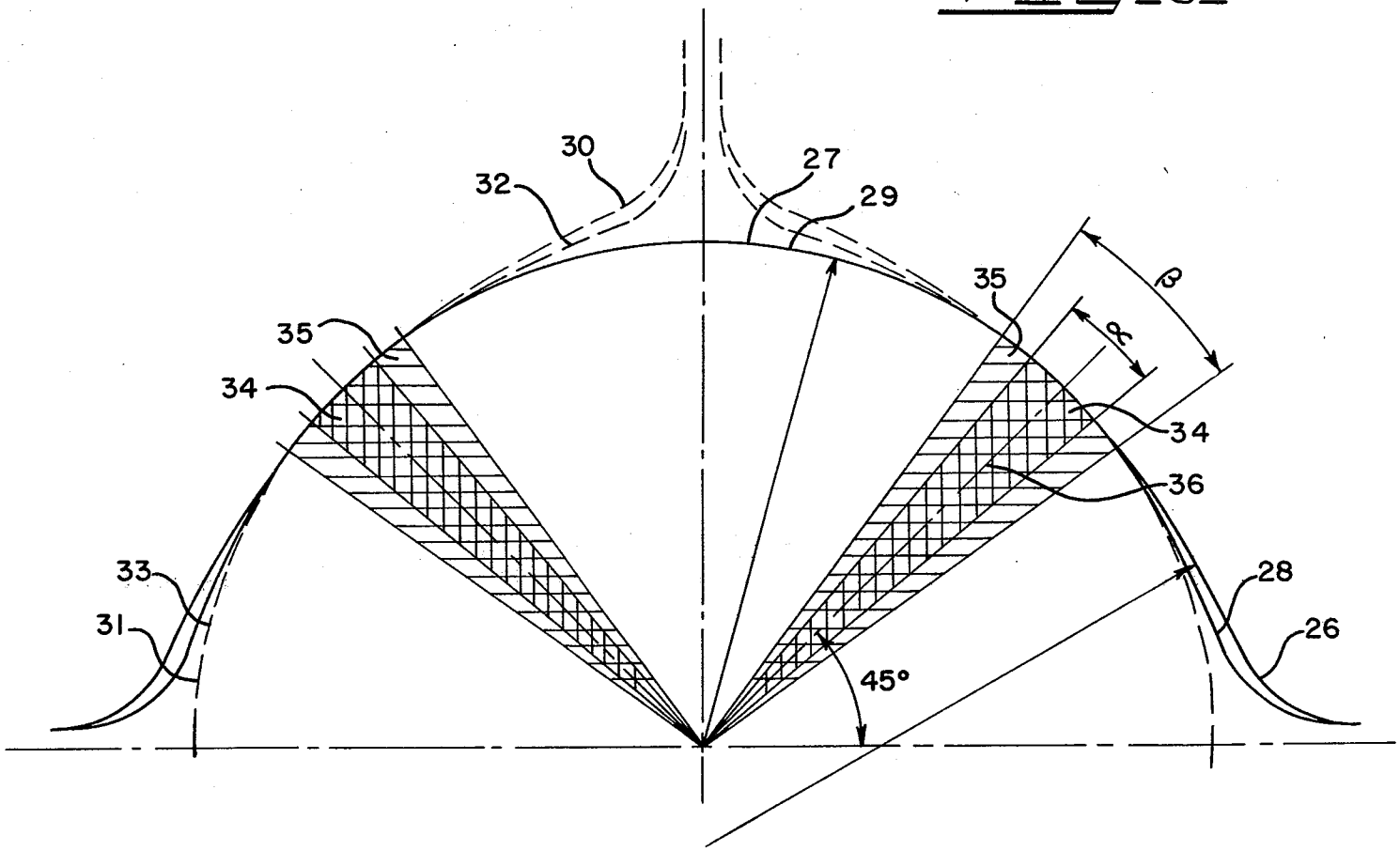

FIG. 3 shows a comparison between the contour of typical grooves used in the method of the invention (wherein the piercing bar is used as continuous rolling mandrel) and those used in the full-floating mandrel process, the represented grooves being those of roll stands finishing the wall thickness.

The contour according in the full-floating mandrel method is shown by the continuous line 26–27 and the one in the method subject of the present invention by the continuous line 28–29. In 27 and 29 both contours are indentical.

The broken lines 30–31 and 32–33 show the contours of the roll grooves of the stand immediately ahead or behind, disposed at 90° to the contour represented in continuous lines. The line 30–31 shows the contour in the full-floating mandrel method and the line 32–33 the one in the method subject of the invention. The portions 31—33 of both contours are identical.

The areas of overlap between two contours of successive grooves are the hatched areas 34 for the full-floating mandrel and 35 for the method of the invention.

It appears that the overlap about the axis 36 disposed at 45° is represented by the angles $\alpha$ and $\beta$ respectively. In the full-floating mandrel method ($\alpha$) the overlap is of about 10°, while in the method of the invention ($\beta$) it is of about 18°.

This figure well illustrates how much closer and nearer the circular shape the grooves according to the invention are as compared to those to the full-floating mandrel method. Rolling is thus facilitated and the quality of the rolled products improved, especially the uniformity of the wall thickness.

The figures and the parameters of the manufacturing schedule already stated by way of example show:

that according to the process of the invention a given tube can be rolled from a given shell with a reduced number of roll stands (6 stands) as compared to the 8 stands of the former full-floating mandrel method, that is to say with at least one roll stand less than the number required in the full-floating mandrel method, that the rolling is carried out in grooves having a more enclosing shape in the case of the invention than in the conventional full-floating mandrel method.

The result is that the process achieves better global rolling conditions entailing a better uniformity both external and internal of the hot rolled tubes (concentricity, no lines, etc.). The improvements are even more prominent when using the mandrel as piercer-elongator bar.

The reduction of the number of roll stands directly leads to a decrease in the required mandrel length by about one stand center distance per eliminated roll stand. The apparatus implementing the present method is, therefore, more economical considering both the investment and the operation costs (less tooling expenses) while providing for a better quality as compared to the former apparatus.

While having been described based on particular examples, the method and apparatus of the invention will, however, be covered in all cases where the above described principles will be applied.

We claim:

1. In a method for continuous hot rolling of a tubular blank over an inside mandrel in a mill embodying a plurality of successive driven roll stands equipped with grooved roll pairs, said roll stands including an inlet roll stand at a front end of the mill, on outlet roll stand at a rear end of the mill, and at least one intermediate roll stand positioned between said inlet and said outlet roll stands, the respective roll stands providing successive passes with each pass decreasing the outer diameter of the blank and extending the length of the blank, positioning the tubular blank with its inside mandrel outside the mill adjacent said inlet roll stand, inserting the blank and mandrel into the mill in such a way that at the time that the tubular blank enters said inlet roll stand the mandrel forward end is located inside the mill between the inlet roll stand and the outlet roll stand, and driving said roll stands so that in said inlet roll stand the blank is rolled at a constant entry speed $V_e$, the improvement comprising controlling the mandrel movement during all times that the blank is engaged at any roll stand by moving the mandrel axially in the same direction as the blank at a constant speed, $V_m$, so that the mandrel is present and controlled at each roll stand, including said outlet roll stand, at the time that the blank leading end reaches each stand, and maintaining said constant speed of the mandrel until the blank leaves said outlet roll stand, the speed of the mandrel being maintained so that ratio $V_m/V_e$ is approximately between 0.75 and 1.30.

2. The method according to claim 1 wherein the mandrel forward end does not extend over more than three quarters of the length of the mill when the forward end of the blank reaches the inlet roll stand.

3. The method according to either claim 1 or 2 wherein the rolling mandrel used in the continuous mill comprises the piercing plug over which the blank is fed during a piercing or elongation operation performed immediately before rolling.

4. The method according to any of claim 1, 2 or 3 wherein the mandrel is released for movement forwardly through the mill when rolling of the tube in the mill is completed.

5. The method according to any of claim 1, 2 or 3 wherein the mandrel is stripped from the tube and retracted backwardly through the mill when rolling of the tube in the mill is completed.

* * * * *